US007850004B2

(12) United States Patent
Picciolo

(10) Patent No.: US 7,850,004 B2
(45) **Date of Patent: *Dec. 14, 2010**

(54) FOOD AND BEVERAGE CONTAINER CARRIER

(75) Inventor: Frank Picciolo, Monroe Township, NJ (US)

(73) Assignee: Paper Board Food Service Properties, Inc., Monroe Township, NJ (US)

( * ) Notice: Subject to any disclaimer, the term of this patent is extended or adjusted under 35 U.S.C. 154(b) by 68 days.

This patent is subject to a terminal disclaimer.

(21) Appl. No.: 12/321,563

(22) Filed: Jan. 22, 2009

(65) Prior Publication Data

US 2009/0127139 A1 May 21, 2009

Related U.S. Application Data

(63) Continuation-in-part of application No. 11/595,050, filed on Nov. 10, 2006, now Pat. No. 7,500,557.

(51) Int. Cl.
*B65D 81/00* (2006.01)

(52) U.S. Cl. ..... 206/162; 206/196; 206/198

(58) Field of Classification Search ..... 206/162, 206/193, 194, 196, 198, 217, 427
See application file for complete search history.

(56) References Cited

U.S. PATENT DOCUMENTS

| | | | | |
|---|---|---|---|---|
| 3,780,906 | A * | 12/1973 | Katzenmeyer | 206/170 |
| 5,765,684 | A * | 6/1998 | Van Dore et al. | 206/427 |
| 5,803,264 | A * | 9/1998 | Gersten et al. | 206/549 |
| 6,230,882 | B1 * | 5/2001 | Wischusen, III | 206/194 |
| 7,500,557 | B2 * | 3/2009 | Picciolo | 206/162 |

* cited by examiner

*Primary Examiner*—J. Gregory Pickett
(74) *Attorney, Agent, or Firm*—Arthur M. Peslak; Gertner Mandel & Peslak, LLC

(57) ABSTRACT

A disposable food and beverage container carrier is disclosed. The container has a lower carrier tray and an upper carrier tray that mate with each other. In another embodiment the two trays can be aligned in the same plane.

4 Claims, 15 Drawing Sheets

FOOD AND BEVERAGE CONTAINER CARRIER

PRIORITY CLAIM

This application is a continuation-in-part of application 11,595,050 filed Nov. 10, 2006, now issued as U.S. Pat. No. 7,500,557.

BACKGROUND OF THE INVENTION

The present invention is directed to the field of disposable carriers for food and beverage containers for use at restaurants, concession stands or other locations where food and beverages are dispensed to customers. In particular, the present invention is directed to an improved carrier for food and beverage containers that provides a strong, durable and rigid carrier for safely transporting food and beverage containers.

Disposable food and beverage containers are well known in the prior art. The prior disposable carriers comprise various configurations, all of which suffer from various defects. The primary object of the present invention is to overcome these defects by providing an inexpensive yet rigid and stable carrier for food and beverage containers.

SUMMARY OF THE INVENTION

A disposable food and beverage carrier assembly comprising a lower carrier tray adapted to receive a plurality of beverage containers comprising a first bottom member, a top member, a handle member centrally located and extending upward from the bottom member and a plurality of beverage container support members each attached to the bottom member and the handle member such that the support members cause the beverage containers to tilt toward the handle member and an upper carrier tray comprising a food carrying container formed from a second bottom member, a plurality of movable perforated apertures in the second bottom member and at least one longitudinal slot adapted to slidingly receive the elongated handle member to thereby form a stable unitary assembly.

DETAILED DESCRIPTION OF THE INVENTION

Figure 1:
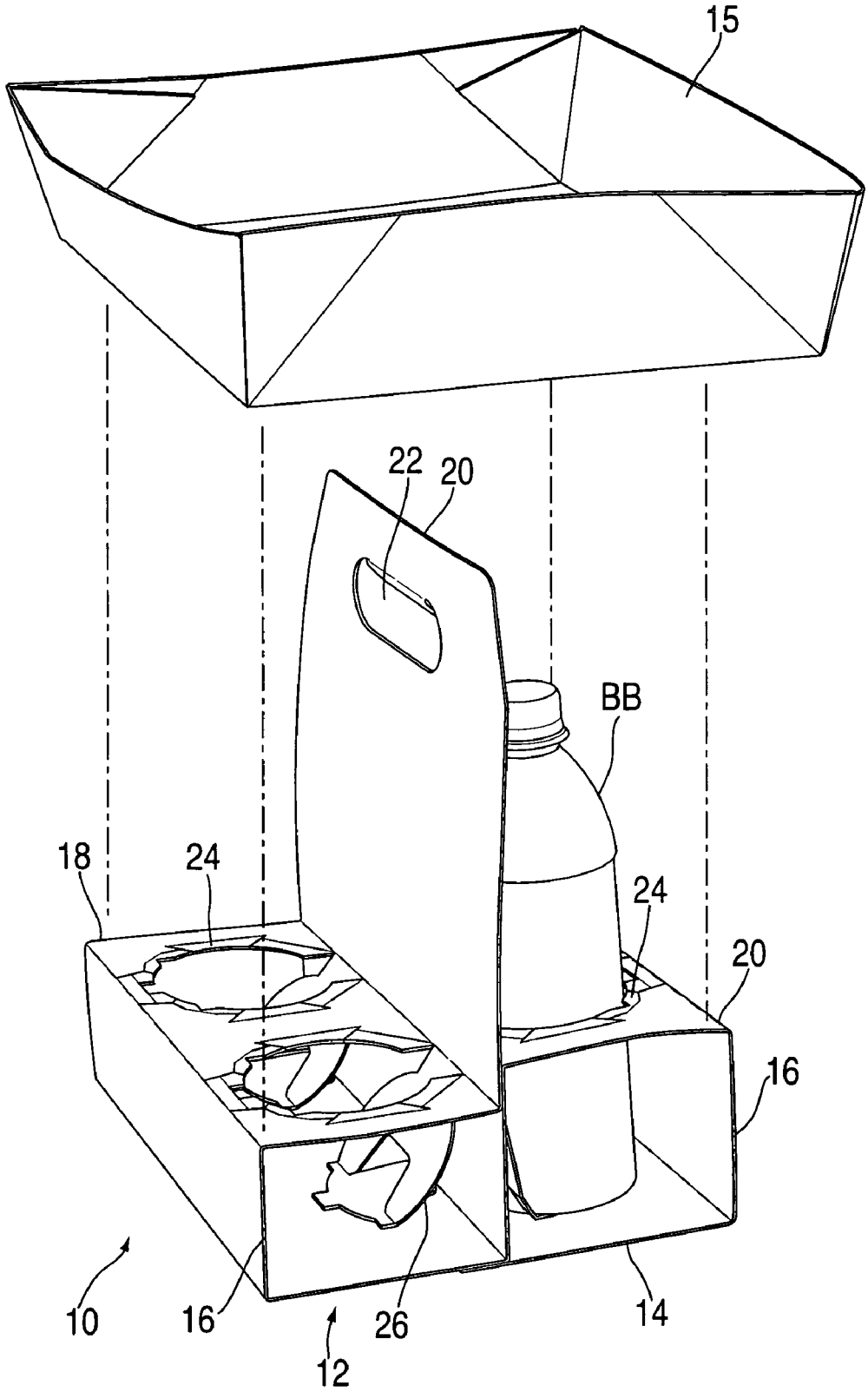
FIG. 1 is an exploded plan view of one embodiment of the present invention.

The present invention will now be described in terms of the embodiments presented in the drawings. Those of ordinary skill in the art will recognize that many obvious modifications may be made thereto without departing from the spirit or scope of the present invention.

FIG. 1 illustrates the first embodiment of the disposable carrier 10 of the present invention. The disposable carrier 10 comprises a lower carrier tray 12 and a mating upper carrier tray 15. The lower carrier tray 12, and the mating upper carrier tray 15, will now be described in detail.

The lower carrier tray 12 is initially fabricated as a foldable flat piece of cardboard or other suitable material. The lower carrier tray 12 is then manipulated at certain folds by a person dispensing food or beverage containers into the three-dimensional form illustrated in FIGS. 1, 2 and 3. The lower carrier tray 12 comprises a bottom member 14, upright walls 16 perpendicular to the base member 14, top members 18 and 19, that are generally parallel to the bottom member 14, and a longitudinally extending handle member 20 perpendicular to bottom member 14. As noted above, the lower carrier tray 12 is fabricated in one piece and folded by the user into the illustrated configuration.

The handle member 20 further comprises a longitudinal slot 22. The slot 22 is adapted to allow a user of the disposable carrier to put his or her hand through the slot to grip the carrier 10 for carrying purposes.

The top members 18 and 20 comprise openings 24 adapted to receive beverage containers such as bottles or cups. The present embodiment illustrates a disposable carrier 12 with four openings 24. Those of ordinary skill will recognize that the embodiment can be readily adapted for a number of openings greater than or less than four without departing from the spirit or scope of the present invention.

The lower carrier tray 12 further comprises a plurality of beverage container support members 26. As can be seen in FIG. 1, as the lower carrier tray 12 is folded into the illustrated configuration, the beverage container support members 26 remain attached to the bottom member 14 and the handle member 20. The beverage container support members 26 are generally aligned with the openings 24.

Figure 5:
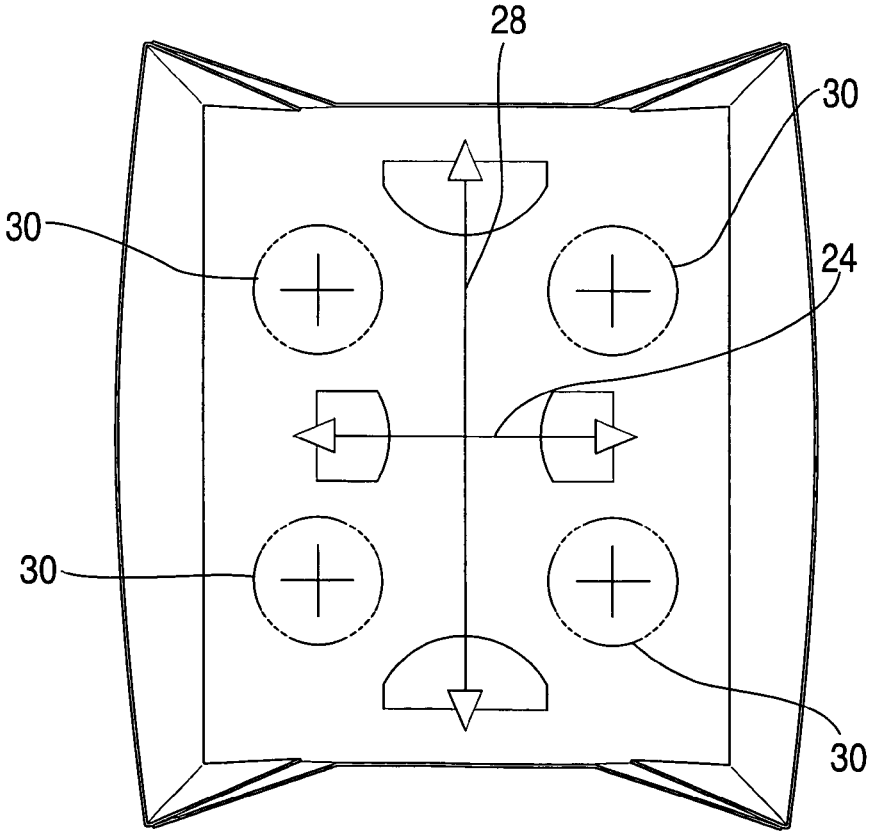
FIG. 5 is a bottom view of a part of the embodiment illustrated in FIG. 1.

The upper carrier tray 15 is generally rectangular in shape. As can be seen in FIG. 5, the upper carrier tray 15 comprises a first longitudinal slot 28, which is adapted to slidingly receive handle member 20. The upper carrier tray 15 further comprises a second longitudinal slot 29 oriented in a direction perpendicular to the first longitudinal slot 28. The upper carrier tray 15 further comprises a plurality of movable circular apertures 30. As with the lower carrier tray 12, the upper carrier tray 15 is fabricated as a flat piece of cardboard or other suitable material and then folded into the configuration shown in FIGS. 1, 2 and 3. When the upper carrier tray 15 is folded into place, a second bottom member 32 is established with four sidewalls 33 generally perpendicular thereto. In this manner, a holding space 31 is formed in the interior of the upper carrier tray 15. The holding space 31 is adapted for the placement therein of food items after the disposable carrier 10 is fully assembled.

Figure 2:
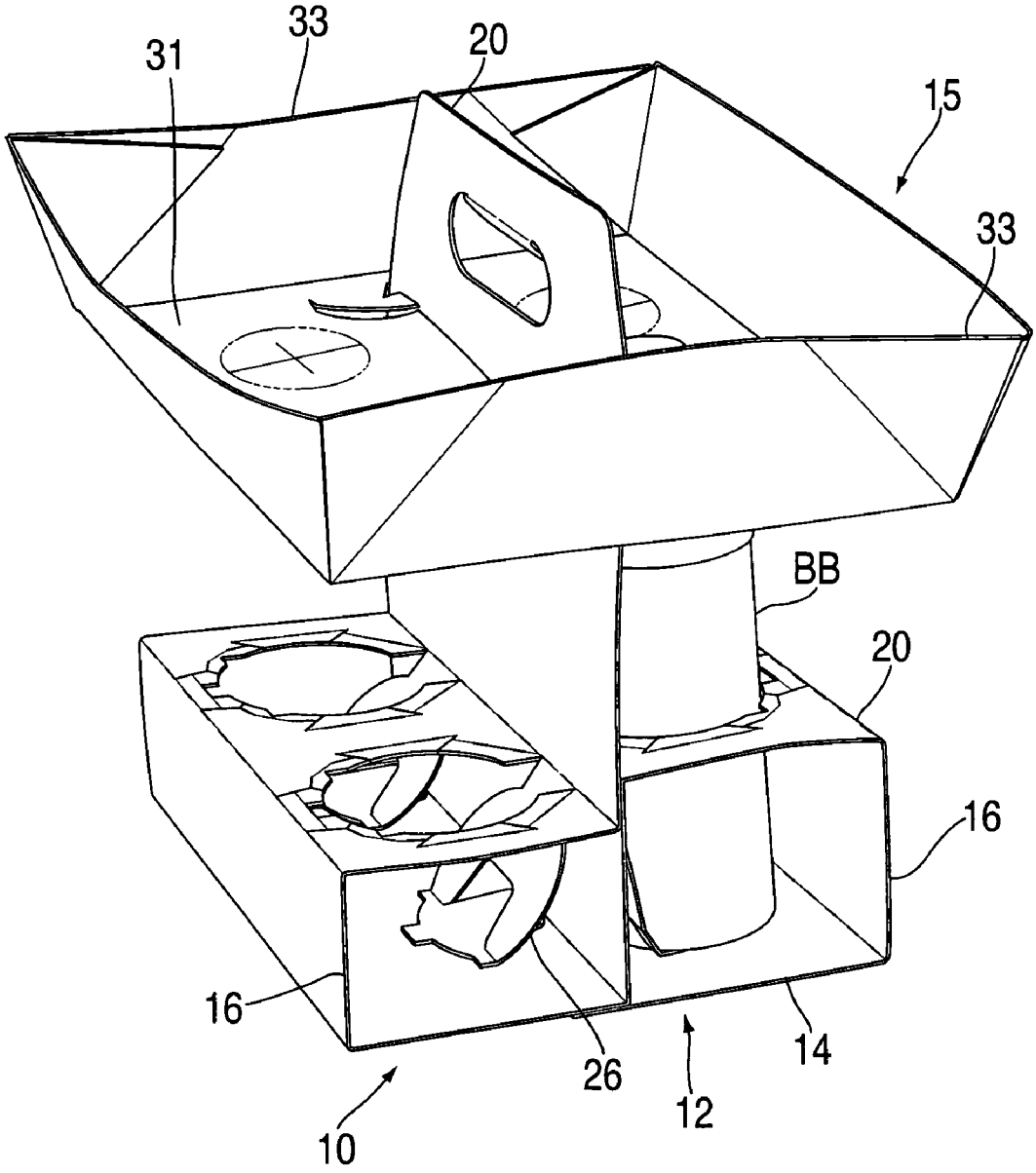
FIG. 2 is an assembled plan view of the embodiment illustrated in FIG. 1.
Figure 3:
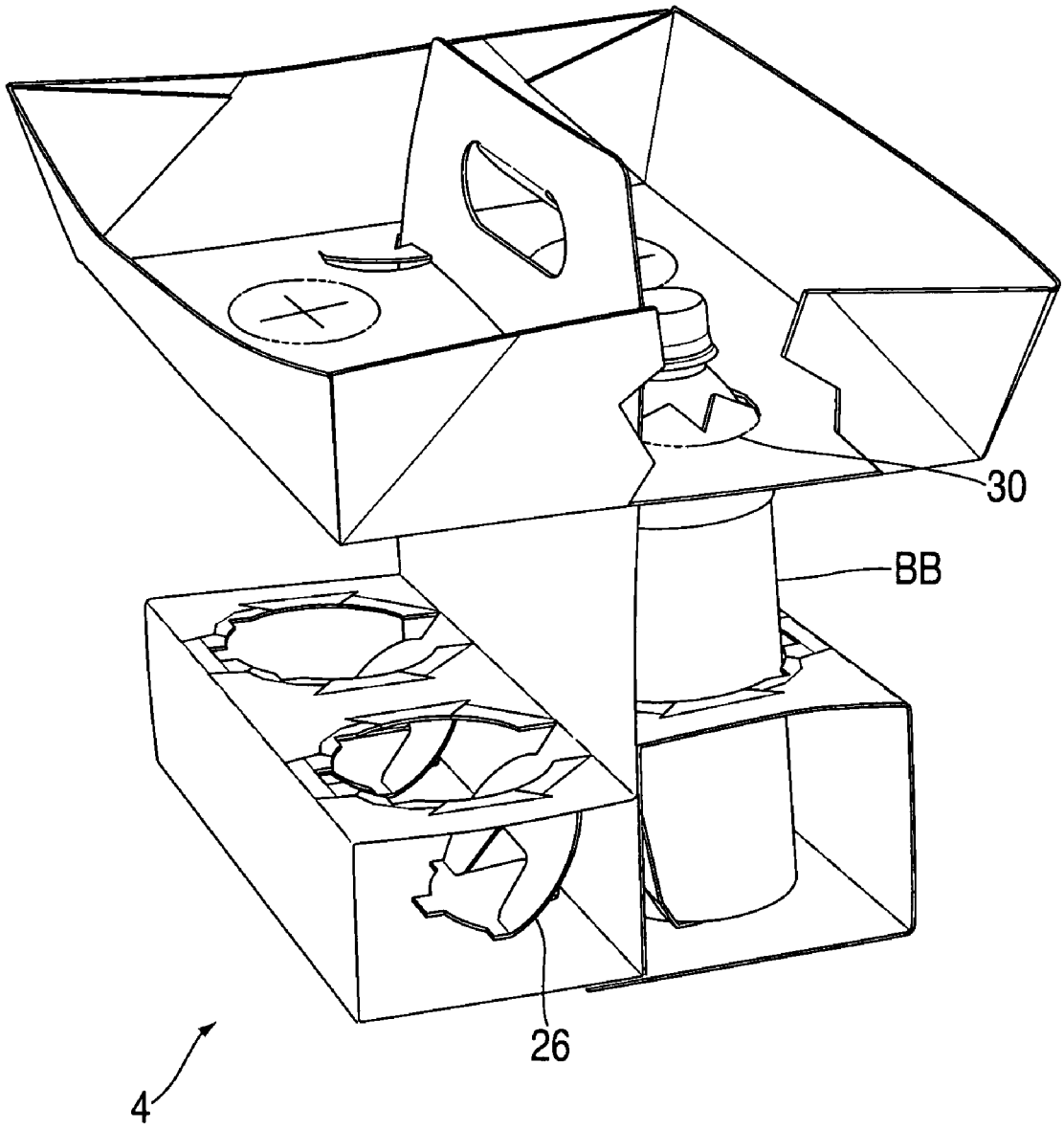
FIG. 3 is a partial cutaway plan view of the embodiment illustrated in FIG. 1.
Figure 4:
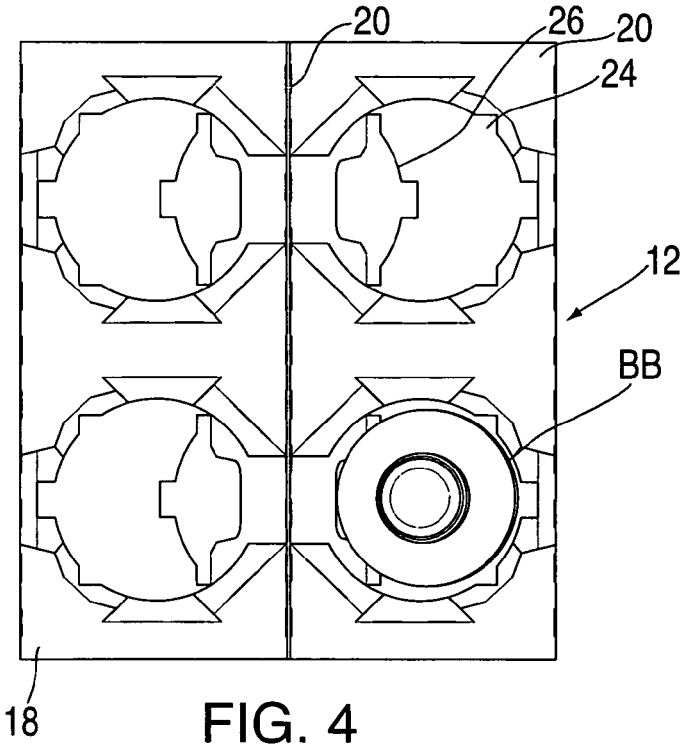
FIG. 4 is a top view of a portion of the embodiment illustrated in FIG. 1.
Figure 6A:
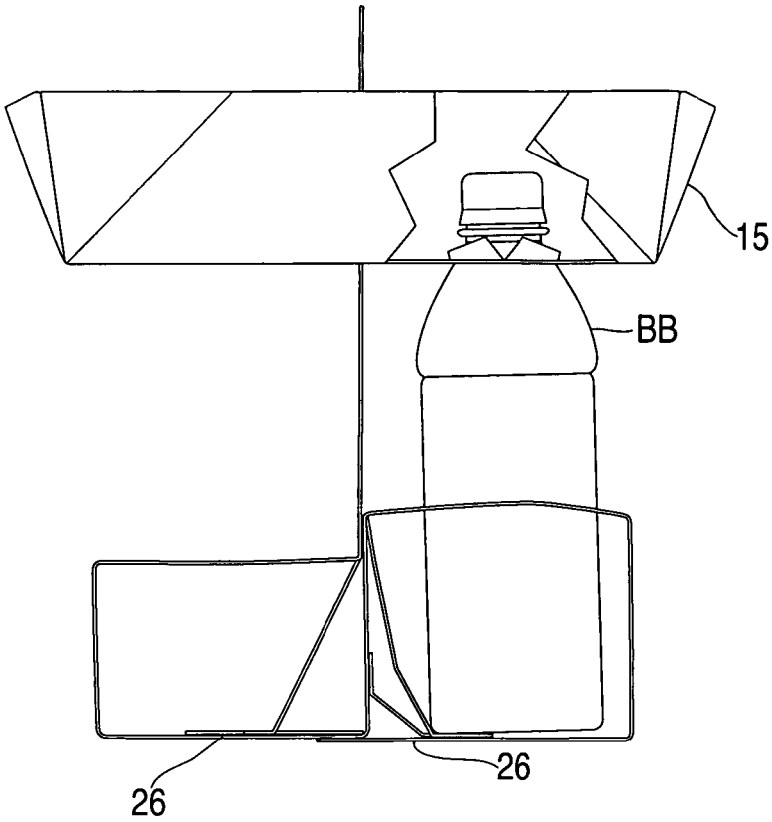
FIGS. 6*a* and 6*b* illustrate side views of an alternate embodiment of the present invention.

FIGS. 2, 3 and 6*a* illustrate the disposable food and beverage carrier 10 as assembled wherein beverage bottles BB are placed. The configuration of the ends of the slots 28 and 29 also provide a frictional locking of the upper carrier tray 15 to the handle member 20. As can be seen in FIG. 3, the top of the bottle BB will be forced through the appropriate circular aperture 30 and protrude upward from the second bottom member 32. When that occurs, the upper carrier tray 15 will be secured to the beverage bottle BB. In this way, a unitary stable unit with the lower carrying tray 12 will be formed. Although the embodiment in FIGS. 1, 2 and 3 is illustrated with a bottle BB, the disposable carrier 10 can also be utilized with a beverage cup. In that case, the top of the cup would not protrude upward from the second base member 32. Rather, the upper carrier tray 15 would rest on top of the cup.

Figure 6B:
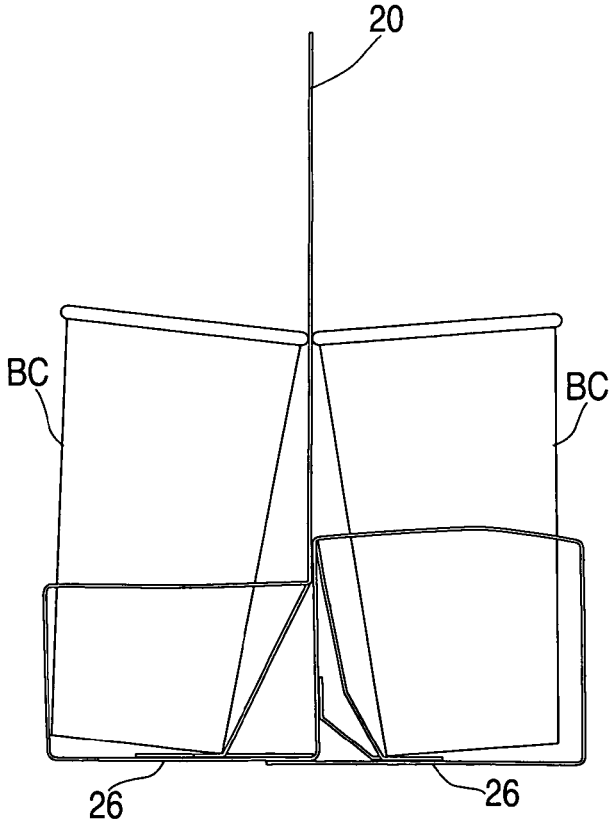

An alternate use of the embodiment of the present invention is illustrated in FIG. 6*b*. In this embodiment, a beverage cup BC is placed in the carrier tray 12. When used with a cup rather than a bottle, the support members 26 tend to tilt the cups inward toward the handle members 20. The slight inward tilt will help prevent the beverage cup BC from spilling outward when carried.

In an embodiment of the carrier 10 where only two beverage holders are provided rather than four as shown in the Figures, the upper carrier 15 can still be utilized. In the case of a two beverage holder carrier 10, the second longitudinal slot 29 which is generally shorter than the first longitudinal slot 28, is used to slidingly connect the upper carrier tray 15 to the handle member 22 of the lower carrier tray 10.

Figure 7:
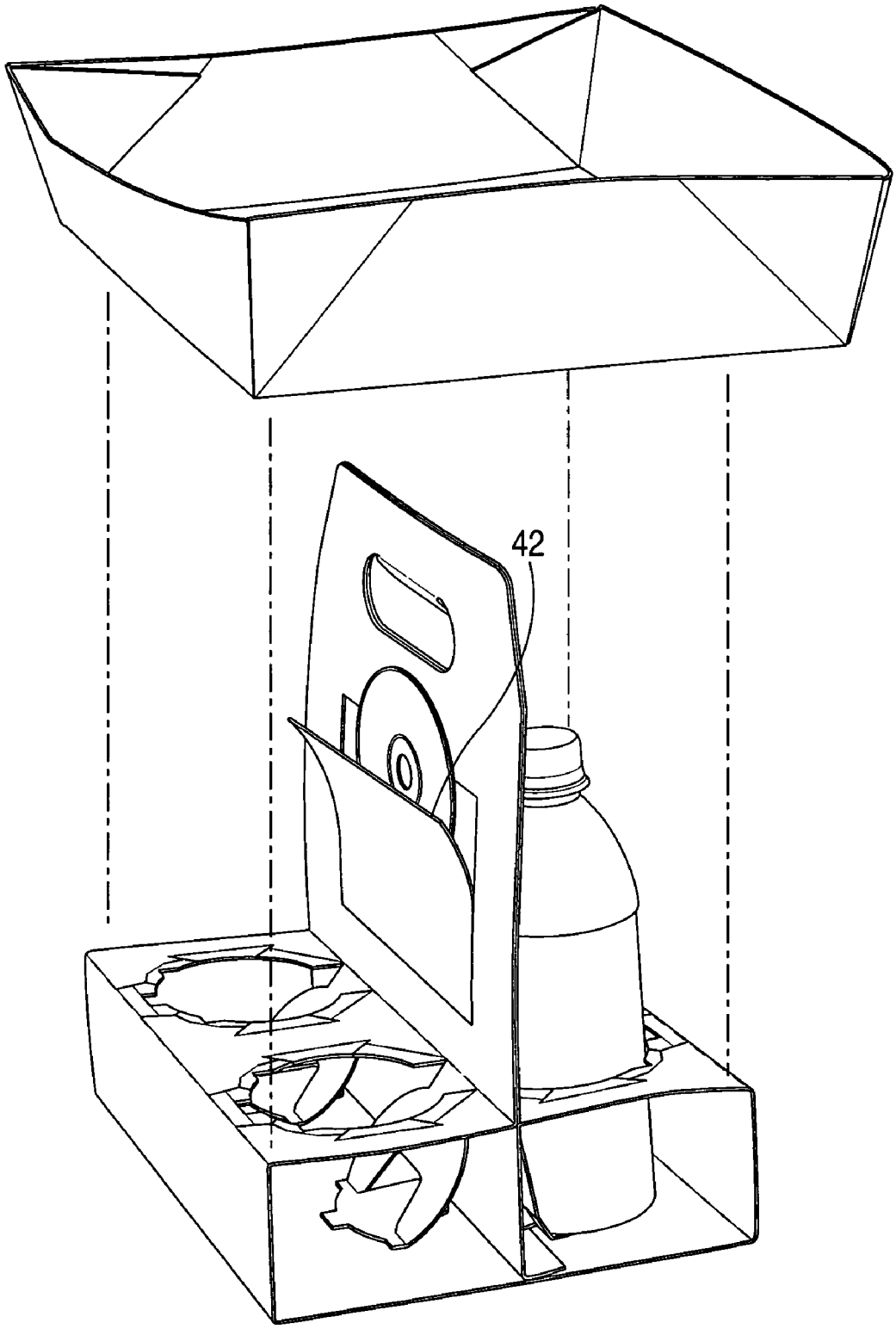
FIG. 7 illustrates an exploded plan view of an alternate embodiment of the present invention.

It is contemplated that either the lower carrier tray 12 or the upper carrier tray 15 can be used as an advertising media. This can be done by printing product or service advertisements on the visible surfaces of the carrier 10. In addition, as shown in FIG. 7, it is presently contemplated that the handle member can be adapted to comprise a slot 42 in which a promotional CD or DVD can be inserted. In addition, the slot 42 can be adapted to hold a promotional coupon or other items such as ketchup or mustard packages as needed.

Figure 8:
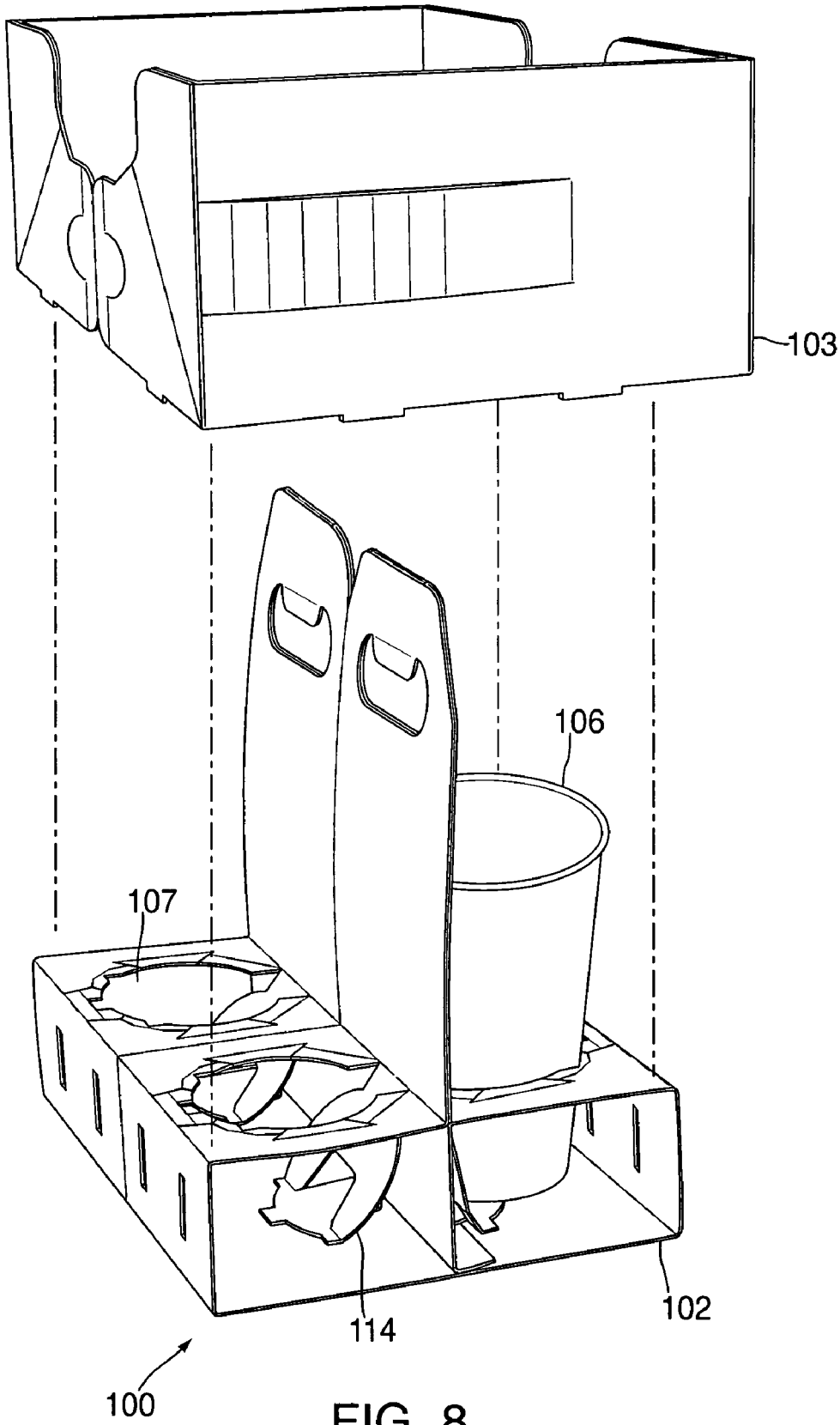
FIG. 8 is an exploded view of an embodiment of the present invention.
Figure 8A:
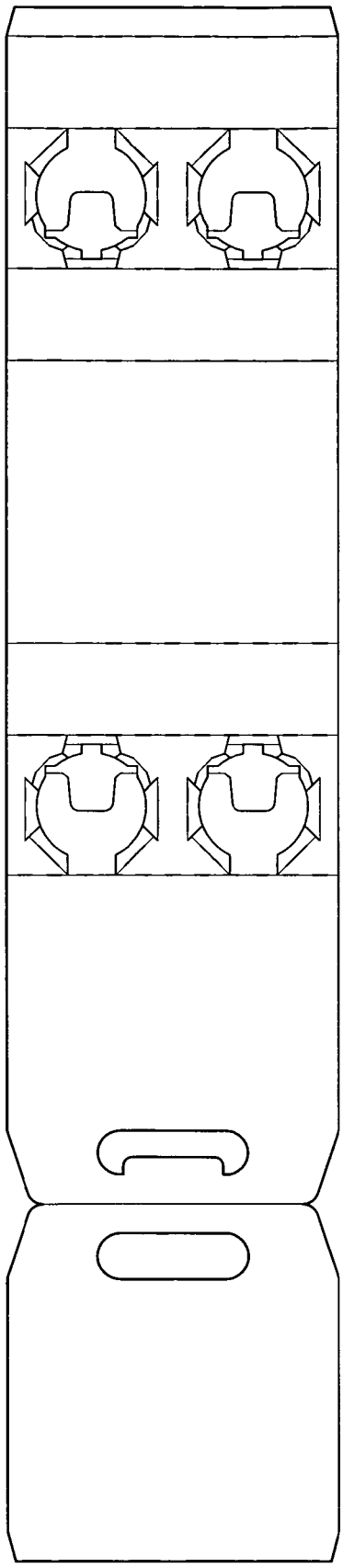
Figure 9:
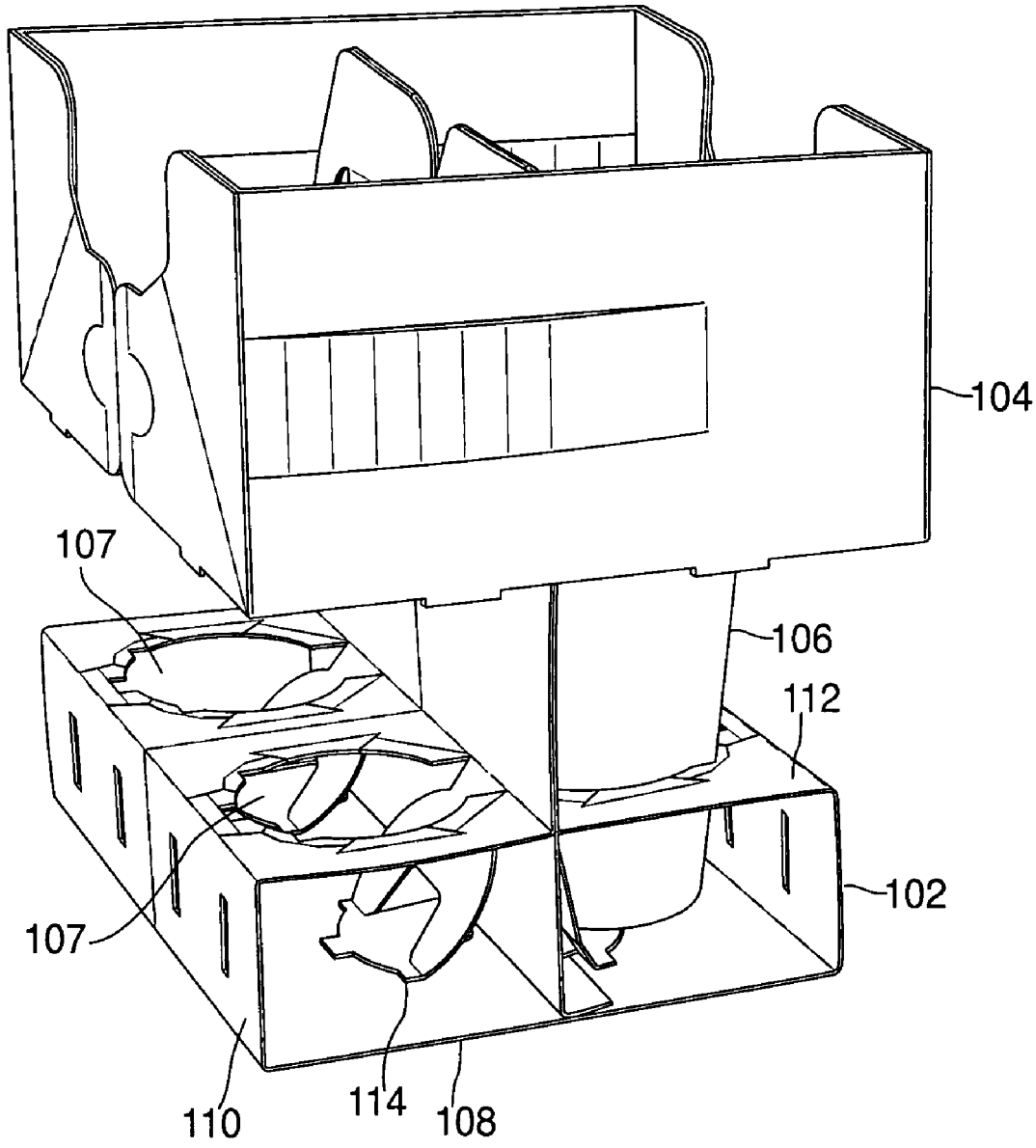
FIG. 9 is an assembled plan view of the embodiment illustrated in FIG. 8.

An alternate embodiment of the food and beverage carrier 100 is illustrated in FIG. 8. The food and beverage carrier comprises a first tray 102 and a second tray 104. As can be seen in FIGS. 8 and 9, the first tray 102 is adapted to receive beverage cups 106. The second tray 104 is adapted to be slidingly received on to the first tray 102 as illustrated in FIG. 9.

Figure 12:
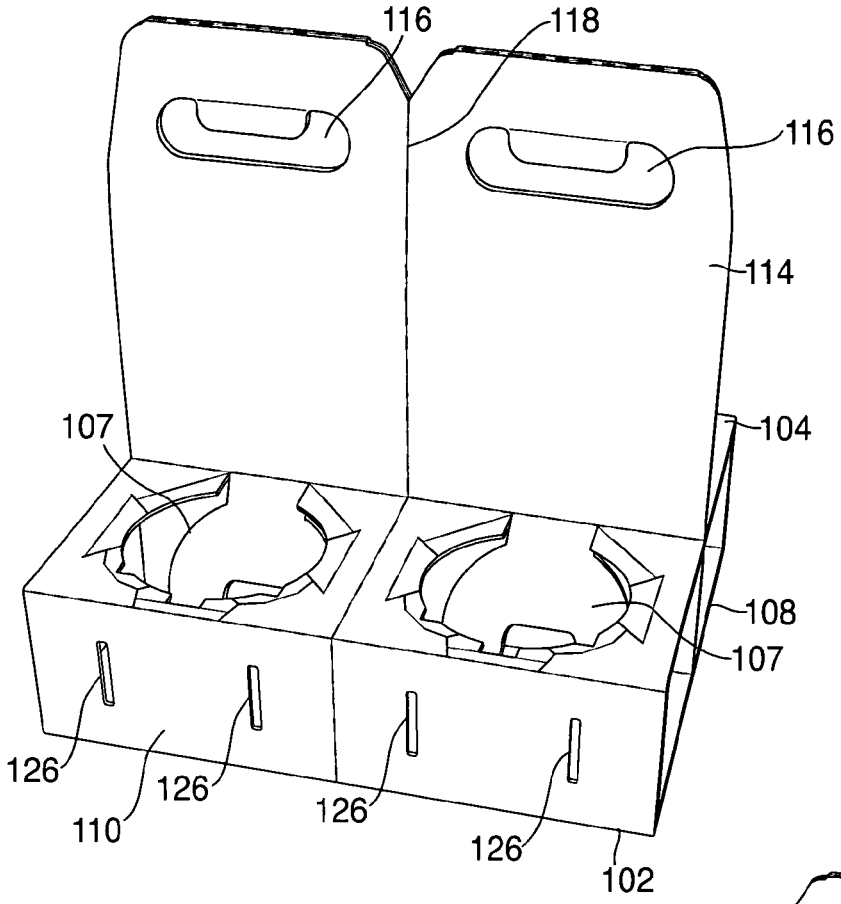
FIG. 12 is a plan view of a part of the embodiment illustrated in FIG. 8.

The first tray 102 is illustrated in detail in FIG. 12. The first tray 102*a* comprises a bottom member 108, upright walls 110, a top member 112 and handle member 114. The first tray 102, as illustrated in FIG. 12, can accommodate up to 4 beverage cups 106 by means of cutouts 107 in the top member 112. The upright walls 110 are generally perpendicular to the bottom member 108 and the top member 112. This embodiment also comprises beverage container support members 114 that are identical in construction to the container support member 26 illustrated in FIG. 1.

The handle member 114 extends generally perpendicular to top member 112. The handle member 114 compiles two cutouts 116 that are adapted for that are adapted for a user's fingers to fit therethrough for carrying purposes.

Figure 13:
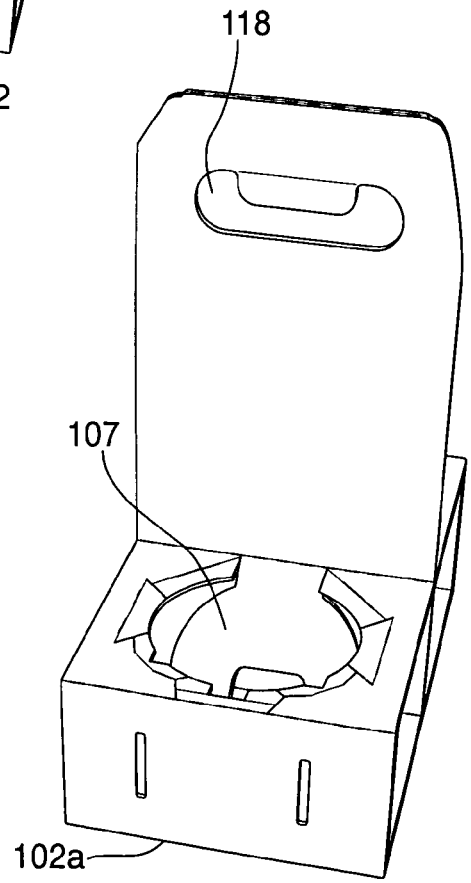
FIG. 13 is a plan view of an alternate embodiment of the part illustrated in FIG. 12

The first tray 102 further comprises a perforation 118. The perforation 118 extends through the bottom member 108, the upright walls 110, the top of member 112 and the handle member 114. The perforation 118 is adapted to allow the first tray 102*a* to be easily split in half by the user to create two two-beverage containers 102*a*. The two-beverage container 102*a* is illustrated in FIG. 13.

Figure 10:
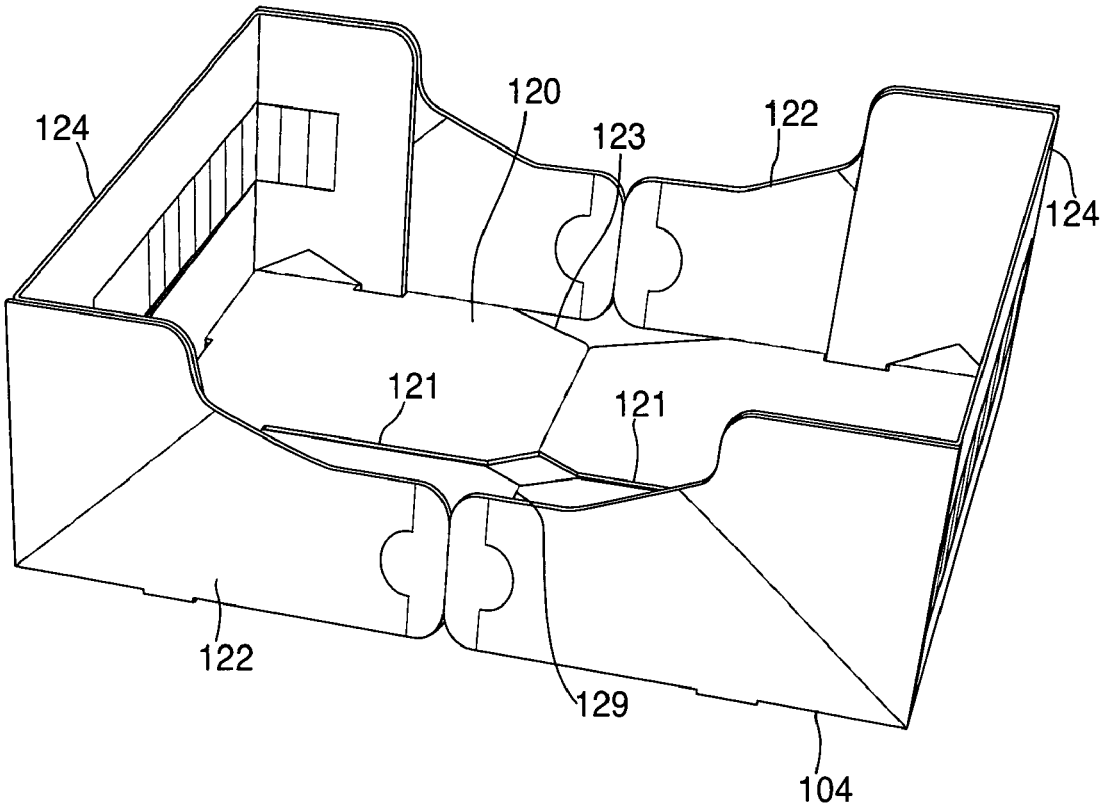
FIG. 10 is a plan view of a part of the embodiment illustrated in FIG. 8.

The second tray 104 is illustrated in detail in FIG. 10. The second tray 104 comprises bottom member 120, first side members 122 and second side members 124. As shown in FIG. 10, the first and second side members 122 and 124 are general perpendicular to bottom member 120. When assembled as shown in FIG. 10, the container 104 is adapted to receive various food items.

The bottom member 120 of second tray 104 comprises a longitudinal slot 121. The handle member 114 on first tray 102 is adapted to be slidingly received in longitudinal slot 121 when the first tray 102 and second tray 104 are assembled as illustrated in FIGS. 8 and 9.

Figure 11:
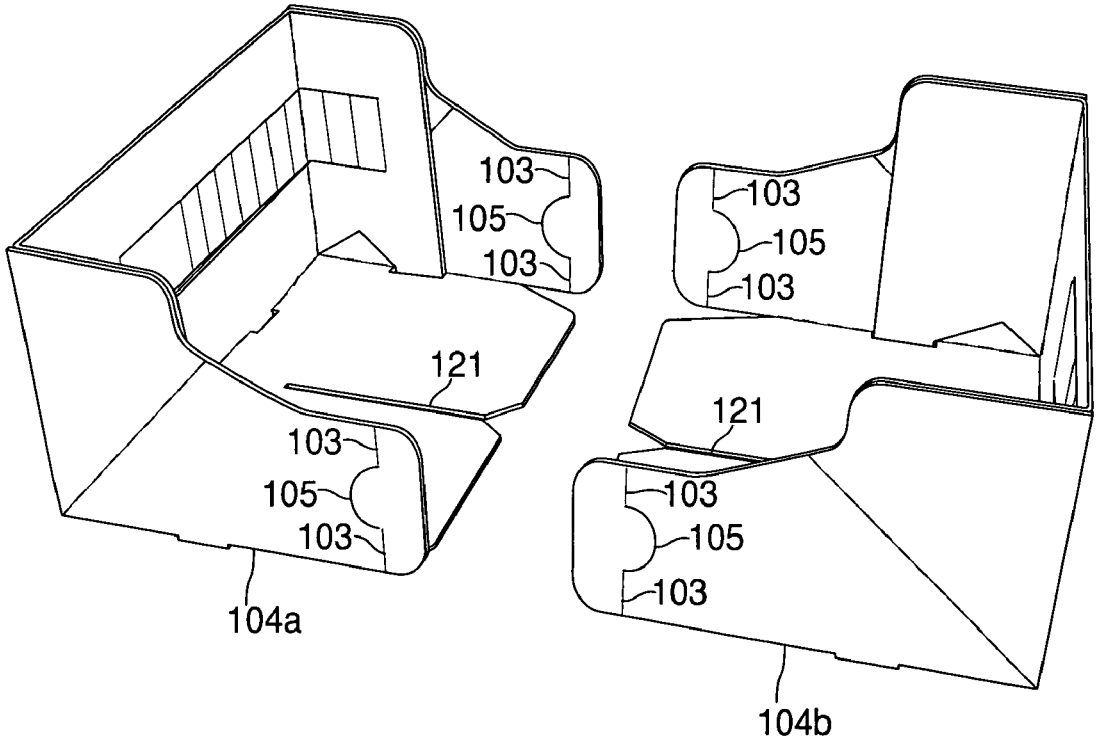
FIG. 11 is an exploded view of the item illustrated in FIG. 10.

The bottom member 120 of the second tray 104 comprises a perforation 123 generally aligned perpendicular to the longitudinal slot 121. As shown in FIG. 11, the perforation 123 is adapted to allow the user to separate the second tray 104 into two trays 104*a* and 104*b*. The bottom second tray 104 further comprises a plurality of creases 103 and a plurality of semi-circular cut-outs 105.

Figure 14:
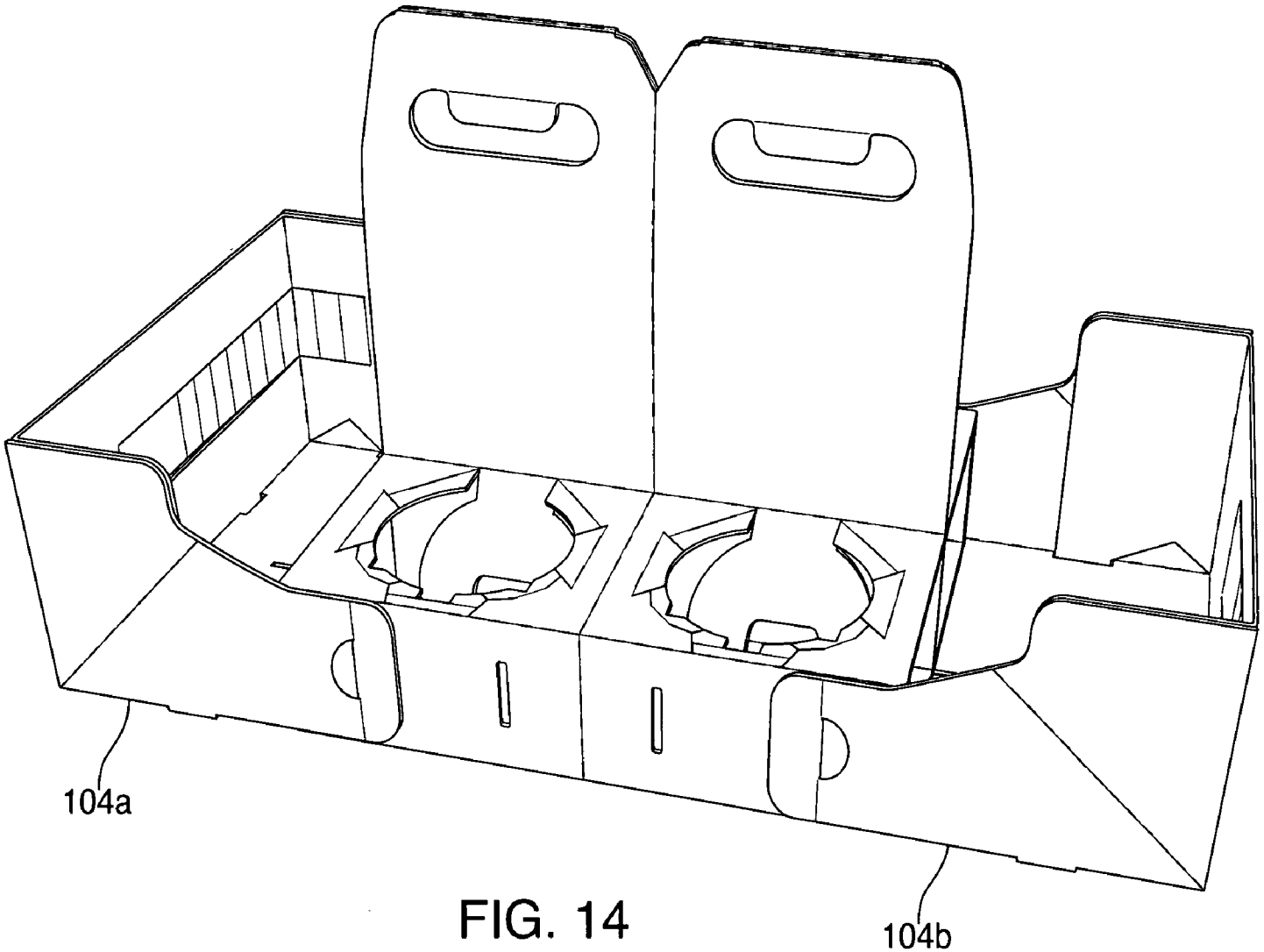
FIG. 14 is a plan view of a second alternate embodiment of the present invention.

The first tray 102 further comprises a plurality of slots 126 in the upright walls 110. The slots 126 are adapted to receive the semi-circular cut-outs, 105 when the first tray 102 and second tray 104*a* and 104*b* are assembled as illustrated in FIG. 14. In order to do so, the crease 103 is bent outward causing the cut-out 105 to bend inward therefrom. As the first trays 104*a* and 104*b* are pushed together, the cut-out 105 will then engage the appropriate slot 126 thereby joining the trays 104*a* and 104*b* to the first tray 102.

Figure 15:
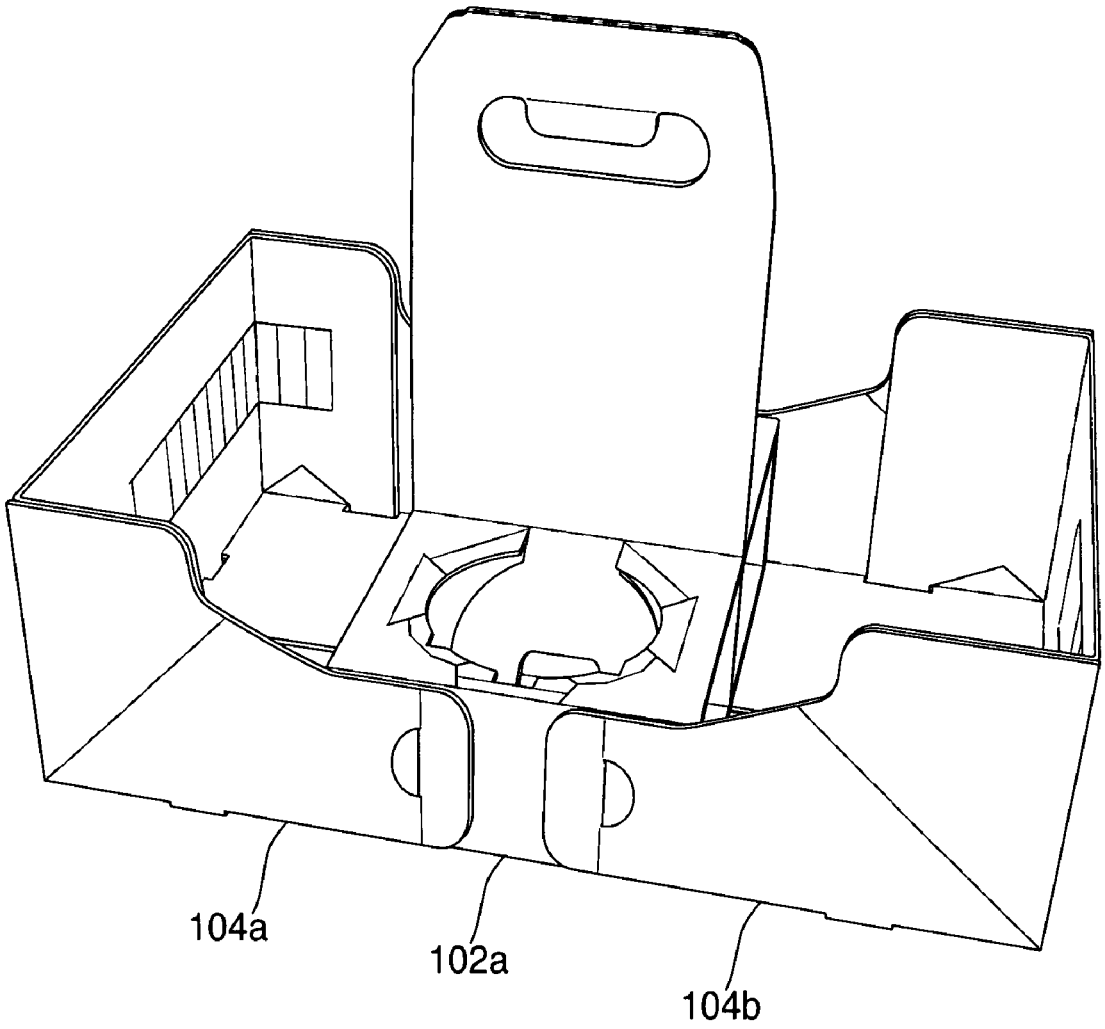
FIG. 15 is a plan view of a third alternate embodiment of the present invention.
Figure 16:
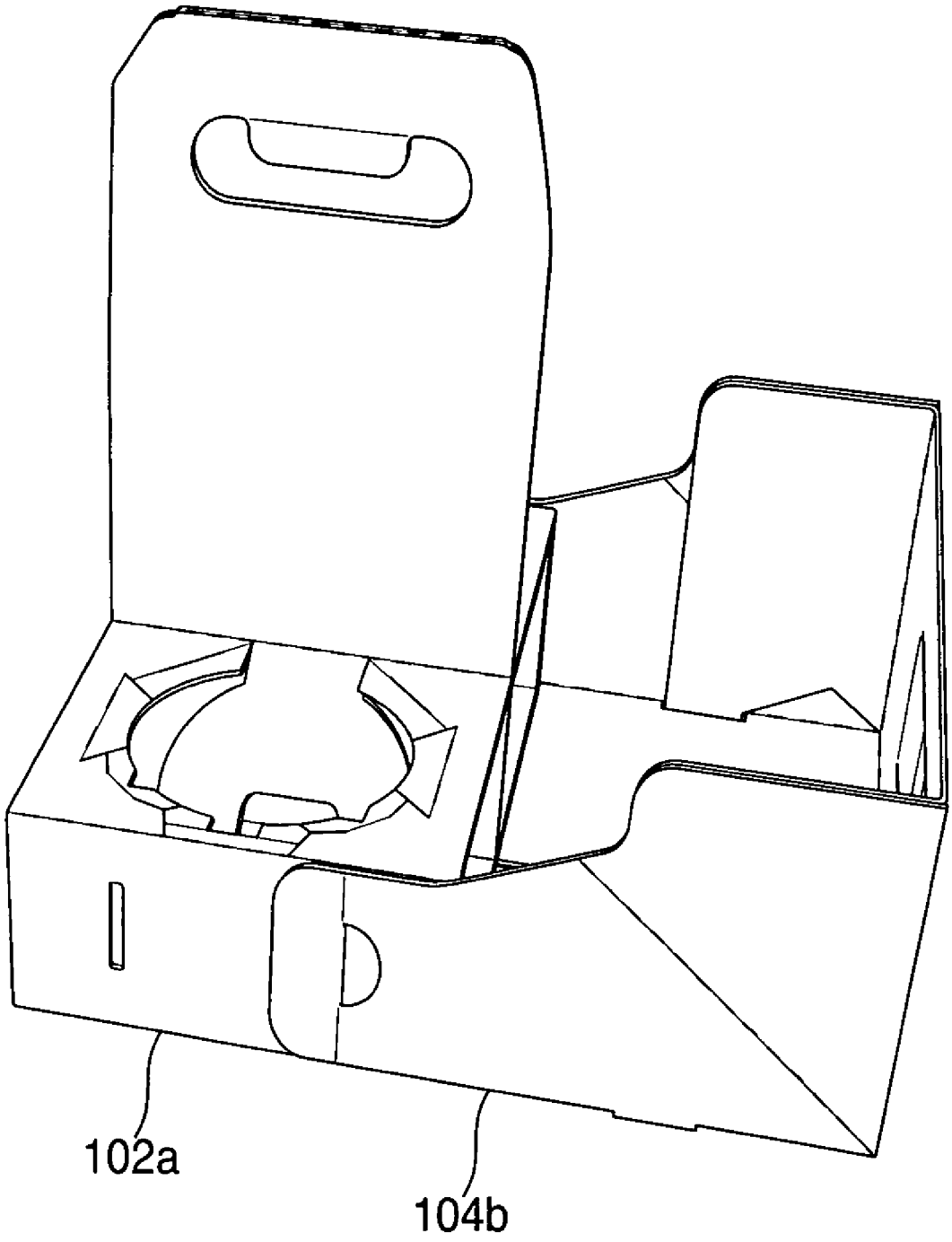
FIG. 16 is a plan view of a plan view of a fourth alternate embodiment of the present invention.

FIG. 15 illustrates an alternate embodiment wherein the two beverage cup holder 102*a* is joined with the second trays 104*a* and 104*b* by the same method as explained above in connection with FIG. 14. Likewise, FIG. 16 illustrates an alternate embodiment wherein the two beverage cup holder 102*a* is jointed to a single second tray 104*b*.

Those of ordinary skill in the art will recognize that the foregoing merely describes embodiments of the present invention and that many obvious modifications are possible without departing from the spirit or scope of the present invention as set forth in the appended claims.

What is claimed is:

1. A disposable food and beverage carrier assembly comprising:

(a) A first tray adapted to receive a plurality of beverage containers comprising a bottom member, upright walls, a top member and a handle member wherein the upright walls are generally oriented perpendicular to the top member and the bottom member and the handle member generally extends upward from the top member and the top member comprises a plurality of openings to accommodate the beverage containers; and (b) A plurality of beverage container support members connected to the bottom member of the first tray and the handle member such that the support members cause the beverage containers to tilt toward the handle member; and (c) A second tray adapted to carry food items therein comprising a second bottom member and side walls generally oriented perpendicular to the second bottom member so as to form a generally rectangular enclosure for the receipt of the food items and wherein the second bottom member comprises a slot adapted to slidingly receive the handle member of the first tray and wherein the second tray is aligned above the first tray and the handle member received in the slot to form the food and beverage carrier assembly.

2. The disposable food and beverage carrier assembly of claim 1 wherein the first tray is adapted to receive four beverage containers and further comprises a second perforation in the bottom member, the upright walls, the top member and the handle member that is adapted to allow the first tray to be split into two fourth trays each adapted to receive two beverage containers.

3. A disposable food and beverage carrier assembly comprising:

(a) A first tray adapted to receive a plurality of beverage containers comprising a bottom member, upright walls, a top member and a handle member wherein the upright walls are generally oriented perpendicular to the top member and the bottom member and the handle member generally extends upward from the top member and the top member comprises a plurality of openings to accommodate the beverage containers; and (b) A plurality of beverage container support members connected to the bottom member of the first tray and the handle member; and (c) A second tray adapted to carry food items therein comprising a second bottom member and side walls generally oriented perpendicular to the second bottom member so as to form a generally rectangular enclosure for the receipt of the food items and wherein the second bottom member comprises a slot adapted to slidingly receive the handle member of the first tray and wherein the second tray is aligned above the first tray and the handle member received in the slot to form the food and beverage carrier assembly; and (d) Wherein the first tray is adapted to receive four beverage containers and further comprises a second perforation in the bottom member, the upright walls, the top member and the handle member that is adapted to allow the first tray to be split into two fourth trays each adapted to receive two beverage containers and the upright walls comprise a plurality of second slots and the second bottom member further comprises a first perforation so that for the second tray can be split into two third trays and wherein each of the third trays comprise semi-circular cutouts on the side walls that are adapted to be received in the plurality of second slots and wherein the two third trays are slidingly received onto one of the fourth trays and the two third trays are joined to said fourth tray by the semi-circular cutouts being slidingly received in the second slots to form the food and beverage carrier assembly wherein the bottom member of the first tray and the second bottom member of the two third trays are generally aligned in the same plane.

4. A disposable food and beverage carrier assembly comprising:

(a) A first tray adapted to receive a plurality of beverage containers comprising a bottom member, upright walls, a top member and a handle member wherein the upright walls are generally oriented perpendicular to the top member and the bottom member and the handle member generally extends upward from the top member and the top member comprises a plurality of openings to accommodate the beverage containers; and (b) A plurality of beverage container support members connected to the bottom member of the first tray and the handle member; and (c) A second tray adapted to carry food items therein comprising a second bottom member and side walls generally oriented perpendicular to the second bottom member so as to form a generally rectangular enclosure for the receipt of the food items and wherein the second bottom member comprises a slot adapted to slidingly receive the handle member of the first tray and wherein the second tray is aligned above the first tray and the handle member received in the slot to form the food and beverage carrier assembly; and (d) Wherein the upright walls of the first tray comprise a plurality of second slots and the second bottom member further comprises a first perforation so that the second tray can be split at the first perforation into two third trays and wherein each of the third trays comprise semi-circular cutouts on the side walls that are adapted to be received in the plurality of second slots and wherein the two third trays are slidingly received into the first tray and the two third trays are joined to the first tray by the semi-circular cutouts being slidingly received in the second slots to form the food and beverage carrier assembly wherein the bottom member of the first tray and the second bottom member of the two third trays are generally aligned in same plane wherein the first tray is adapted to receive four beverage containers and further comprises a second perforation in the bottom member, the upright walls, the top member and the handle member that is adapted to allow the first tray to be split into two fourth trays each adapted to receive two beverage containers and the upright walls comprise a plurality of second slots and the second bottom member further comprises a first perforation so that for the second tray can be split into two third trays and wherein each of the third trays comprise semi-circular cutouts on the side walls that are adapted to be received in the plurality of second slots and wherein the two third trays are slidingly received onto one of the fourth trays and the two third trays are joined to said fourth tray by the semi-circular cutouts being slidingly received in the second slots to form the food and beverage carrier assembly wherein the bottom member of the first tray and the second bottom member of the two third trays are generally aligned in the same plane.

* * * * *